US006354631B1

(12) United States Patent
Jackson

(10) Patent No.: US 6,354,631 B1
(45) Date of Patent: Mar. 12, 2002

(54) TOY FOR PRODUCING A CONCEALED MESSAGE AND REVEALING A RECEIVED CONCEALED MESSAGE

(76) Inventor: Lori K. Jackson, 2213 High Point Dr., Carrollton, TX (US) 75007

( * ) Notice: Subject to any disclaimer, the term of this patent is extended or adjusted under 35 U.S.C. 154(b) by 0 days.

(21) Appl. No.: 09/532,593

(22) Filed: Mar. 22, 2000

(51) Int. Cl.[7] ..... B42D 15/00
(52) U.S. Cl. ..... 283/114; 281/39; 283/110
(58) Field of Search ..... 281/15.1, 38, 39, 281/51; 402/4; 283/72, 76, 91, 92, 93, 107, 109, 110, 111, 114, 901, 902, 903; 428/916; 434/410

(56) References Cited

U.S. PATENT DOCUMENTS 1,407,239 A * 2/1922 Weiss ..... 281/39
4,824,144 A * 4/1989 Tasma ..... 283/114 X
5,984,367 A * 11/1999 Barnhart et al. ..... 283/92

* cited by examiner

*Primary Examiner*—Willmon Fridie, Jr.
(74) *Attorney, Agent, or Firm*—F. Lindsey Scott

(57) ABSTRACT

A toy for producing a concealed message by producing a message on a message paper including a busy reddish pattern and for revealing a concealed message from a second party on a message paper including a busy reddish pattern by viewing the message under a translucent member having a similar red color.

19 Claims, 4 Drawing Sheets

TOY FOR PRODUCING A CONCEALED MESSAGE AND REVEALING A RECEIVED CONCEALED MESSAGE

BACKGROUND OF THE INVENTION

1. Field of the Invention

This invention relates to a toy for enabling a user of the toy to produce a concealed message for forwarding to a second party and for revealing a concealed message received from a second party to the user.

2. Brief Description of the Prior Art

The use of colored backgrounds, especially red backgrounds having a busy pattern to conceal messages written on such backgrounds, has been disclosed in U.S. Pat. No. 4,189,353. This patent discloses a system for transmitting confidential information through the mail. It requires that the recipient have a red colored transparency, which is placed over the message to interpret the message.

In U.S. Pat. No. 5,312,656, a plate of a translucent red material is placed on a surface, which includes a translucent upper surface covered with a red/yellow obscuring design so that the user of the plate can see an otherwise concealed design through the bottom of the plate.

SUMMARY OF THE INVENTION

The present invention comprises a toy for enabling a first party to produce a concealed message and to reveal a concealed message from a second party. The toy comprises: a toy body having a first side and a second side, a top and a bottom and a first and second end and includes a concealed message-production surface and a concealed message-revealing window. A message paper of a size and configuration suitable for positioning on the message-production surface and for positioning for viewing through the concealed message-revealing window and having on its message-bearing surface a concealing design of a selected color is used to transmit messages.

In some embodiments, the concealed message-production surface and the concealed message-revealing window may be positioned on opposite sides of the toy.

In a further embodiment, the toy of the present invention may have the message-production surface and the concealed message-revealing window on the same side of the toy. The message-revealing window may be raisable to use the same surface for the message display surface and for the message-production surface.

In a further embodiment, the toy of the present invention is adapted to function as a table-top model and the message-revealing window and the message-production surface may be on either side or on the same side of the toy.

The toy may be adapted to be worn as a bracelet/wrist watch, a necklace, on a belt, or the like.

In a further embodiment, the toy may include an electric or electronic message-generating system which generates the message-containing media which includes a concealing design of a selected color and a message-revealing window.

DESCRIPTION OF THE PREFERRED EMBODIMENTS

In the discussion of the Figures, the same numbers will be used throughout to refer to the same or similar components.

In many instances, young children or teenagers wish to play games relating to the generation of secret notes, messages and the like, which are then passed to other children or teenagers for interpretation.

Figure 1:
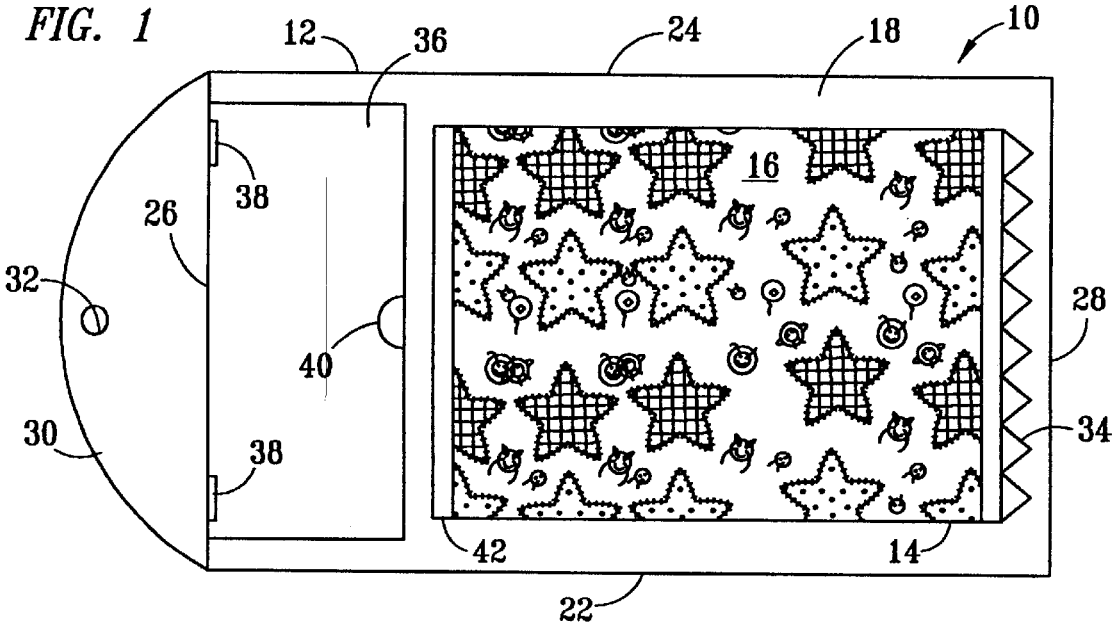
FIG. 1 is a top view of an embodiment of the toy of the present invention.

In FIG. 1, a top view of an embodiment of the toy of the present invention is shown. The toy 10 comprises a toy body 12 having a message-production surface 14 on its top 18 and a first side 22, a second side 24, a first end 26 and a second end 28 and a bottom 20. In FIG. 1, surface 14 is covered with a message paper 16, which will be discussed further below. Message paper 16 is in position for the composition of a message which is accomplished by writing on message paper 16 and thereafter removing a section of message paper 16, for instance by a plastic cutter section 34 positioned near a second end 28 of body 12. At a first end 26 of body 12, a tab 30 including a receptacle 32 for a chain or the like is positioned for use in wearing the toy as a necklace or the like.

In the embodiment shown in FIG. 1, the message paper is supplied by storing a roll of the paper in a paper storage compartment which is shown by a paper storage compartment door 36 having hinges 38 and a tab 40 for opening door 36. A roll of message paper is placed in the paper storage compartment and one of its ends is fed into a slot 42 so that the message paper can be withdrawn from the paper storage compartment and extended over surface 14 as shown in FIG. 1. Sections of the message paper are then torn off as the messages are completed.

Figure 2:
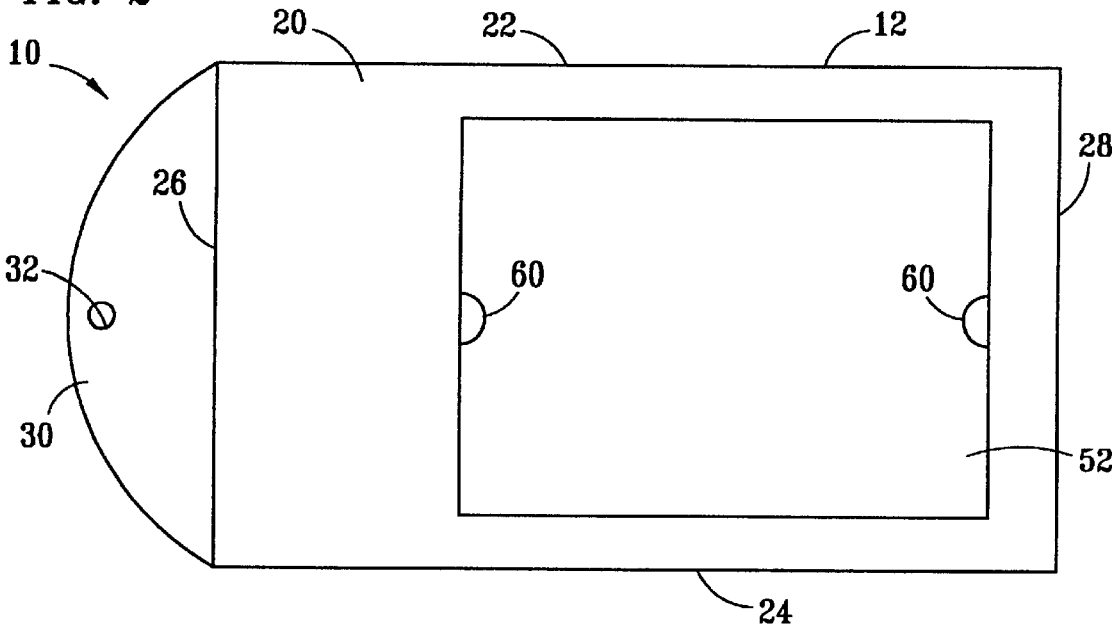
FIG. 2 is a schematic diagram of the back of the embodiment shown in FIG. 1.
Figure 4:
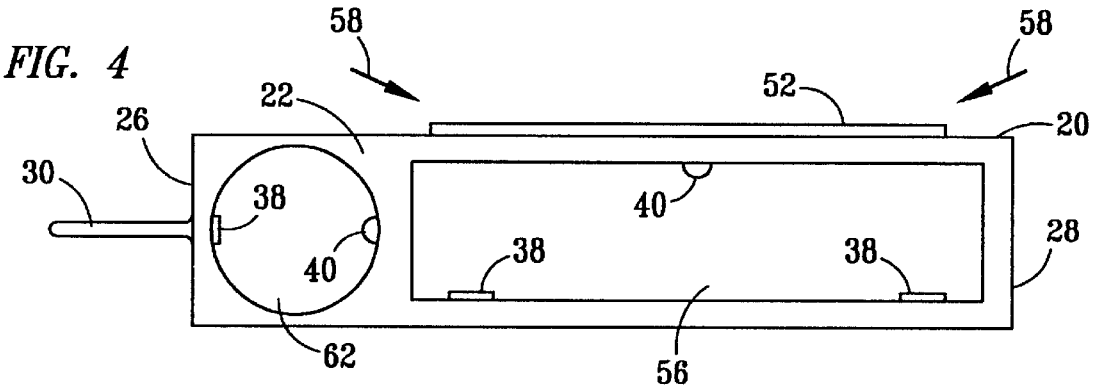
FIG. 4 is a side view of an alternate embodiment of the toy shown in FIG. 1.

FIG. 2 is a schematic view of bottom 20 of the embodiment shown in FIG. 1. Bottom 20 includes a translucent section or sheet 52 which is supported with a slight distance between bottom 20 and section 52 to form an opening between bottom 20 and section 52 so that messages received from others can be slipped under translucent sheet 52. The messages are slid under the translucent sheet where they are readily legible. Cut outs 60 may be provided at each end of translucent sheet 52 to facilitate the removal of received messages after they have been read. As shown in FIG. 4, translucent sheet 52 is supported with a slight distance between bottom 20 and sheet 52 to provide an opening beneath sheet 52 so that received messages are readily slid under translucent sheet 52 as shown by arrow 58.

Figure 3:
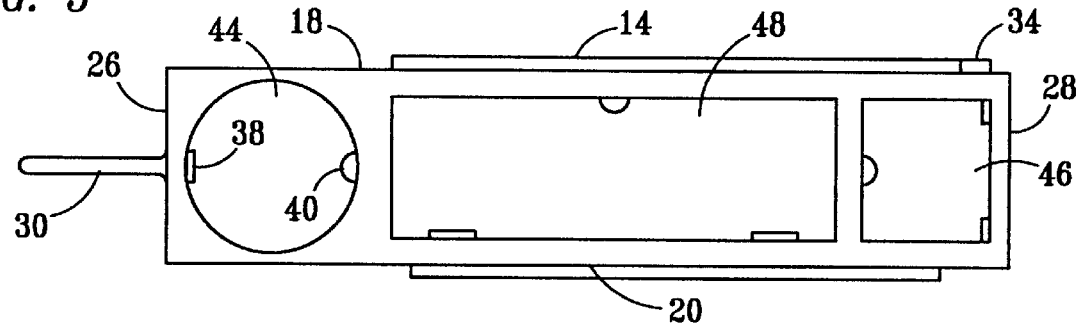
FIG. 3 is a side view of the embodiment shown in FIG. 1.

In FIG. 3, a view of first side 22 of toy 10 is shown. As an alternative to the use of door 36 to place message paper in the message paper compartment, a door 44 may be used on first side 22. The embodiment shown in FIG. 1 functions in substantially the same way as the embodiment in FIG. 3.

Compartments 46 and 48 are shown for storing pencils for writing messages, received messages, erasers and the like. A wide variety of compartment configurations can be used.

With reference to FIG. 4, a view of second side 24 of the embodiment shown in FIG. 2 is shown. In this embodiment, a larger compartment 56 is shown. This compartment may be used when it is desired to use cards of a particular size and width configured to fit surface 14 and to slide under translucent covering 52. The use of such cards may be desirable in some instances rather than using a roll of paper and cutting the paper to length. In such instances, a compartment 62 may be provided for storing pencils and the like. A wide variety of configurations are possible in the placement of compartments in the toy body.

Figure 5:
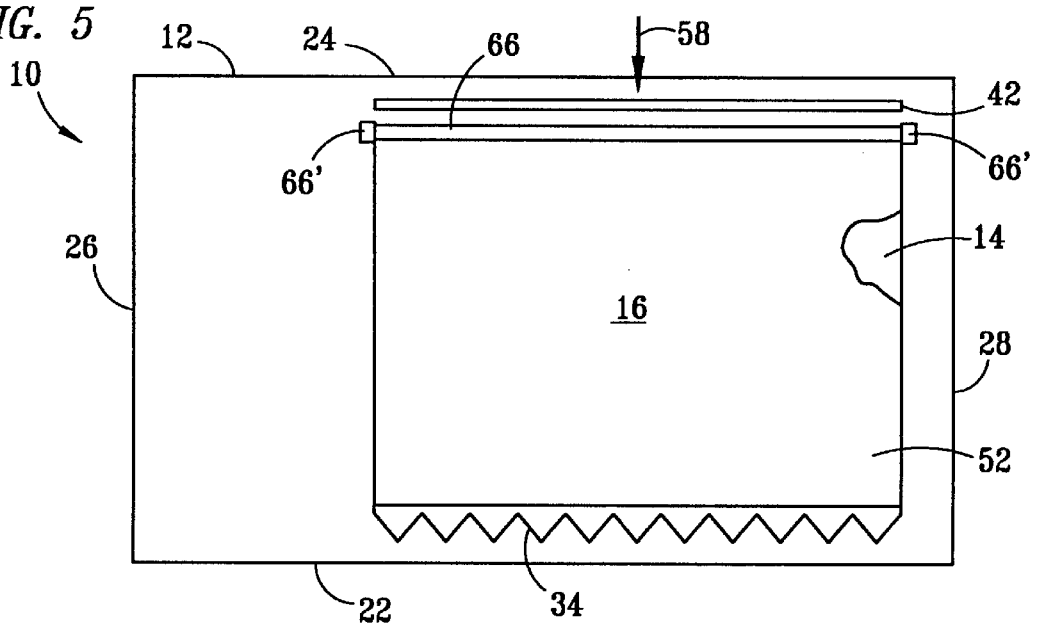
FIG. 5 is an alternate embodiment of the toy of the present invention.
Figure 6:
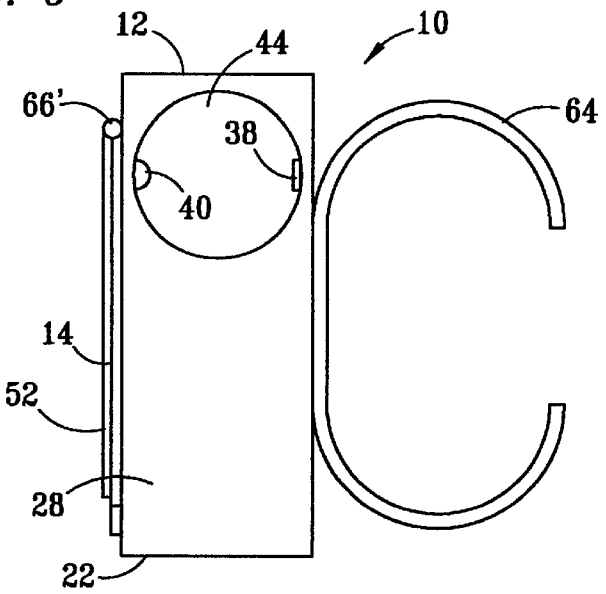
FIG. 6 is an end view of the embodiment shown in FIG. 5.

In FIGS. 5 and 6, an alternate positioning of the message paper compartment is shown. In this embodiment, the paper is passed across the width rather than the length of surface 14, as shown by arrow 58. In FIG. 6, the toy also contains a hinge 66 supported from its ends 66' to permit the passage of paper between ends 66' of the hinge. The hinge surface supports translucent sheet 52 which may be raised to permit the use of surface 14 as a message-production surface with the same surface being used as a message-interpretation surface by lowering translucent sheet 52 over a paper bearing a message positioned on surface 14. The toy, as shown in FIGS. 5 and 6, is adapted for wear as a bracelet by the use of a bracelet fitting 64. Bracelet fitting 64 may take any of a variety of configurations varying from an expandable bracelet shaped member to an expandable watch-band-like retaining member to a bucklable strap member and the like. Such variations are well known to those skilled in the art and will not be discussed further. In the embodiment shown in FIGS. 5 and 6, both the message-production surface and the message-interpretation surface are positioned on the same side of the toy. Compartments may be positioned in the toy in a variety of configurations as discussed above, or in other configurations as known to those skilled in the art.

Figure 7:
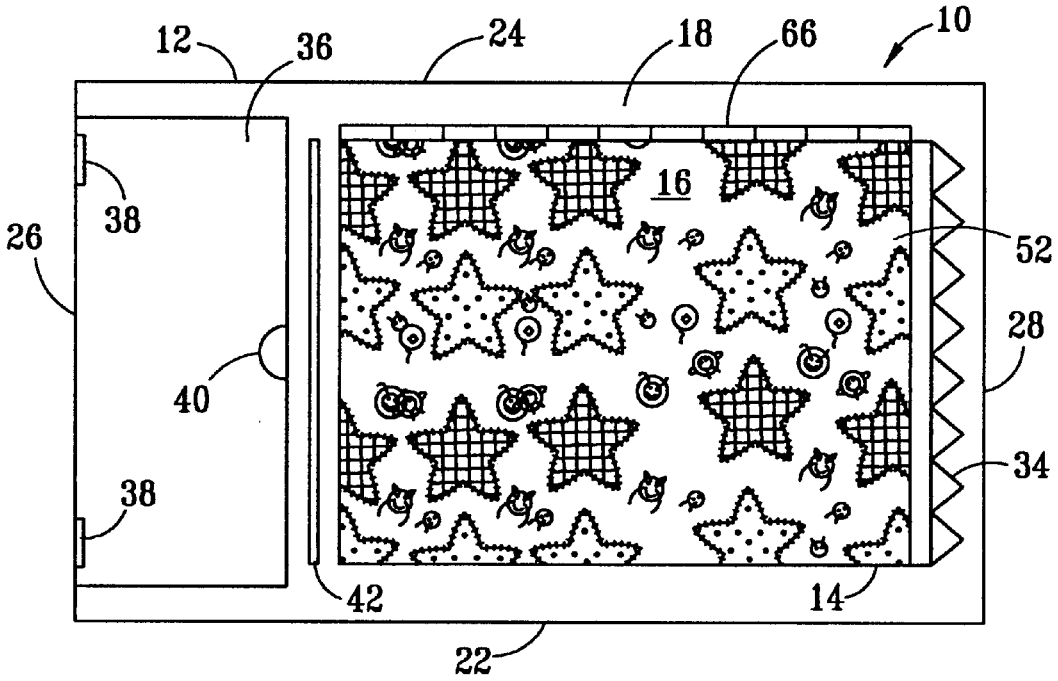
FIG. 7 is an alternate embodiment of the toy of the present invention.
Figure 8:
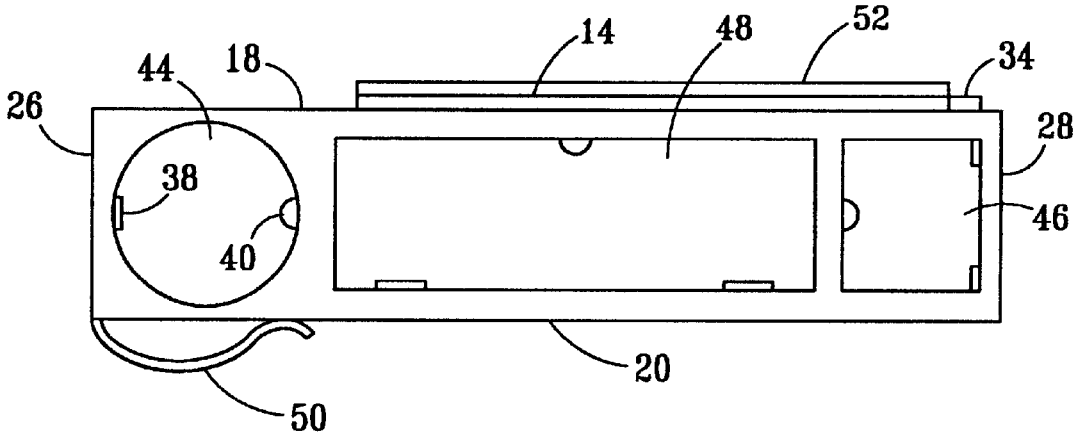
FIG. 8 is a side view of the embodiment shown in FIG. 7.

In FIGS. 7 and 8 a similar embodiment to the toy of FIG. 1 is shown. In this embodiment, the translucent surface is hinged so that the same surface may be used as the message-production surface 14 and as the message-interpretation surface. The translucent member 52 may be raised from message-production surface 14 to position message paper on message-production surface 14 for the creation of a message or a message-bearing message paper may be placed on surface 14 with the translucent cover being lowered over the message-bearing paper to interpret the message. In the embodiment shown in FIGS. 7 and 8, the toy may be worn as a belt attachment by the use of belt loops 50 or the like. Belt loops 50 may assume a variety of configurations such as spring clips, as shown, loops to receive a belt, or the like.

Figure 9:
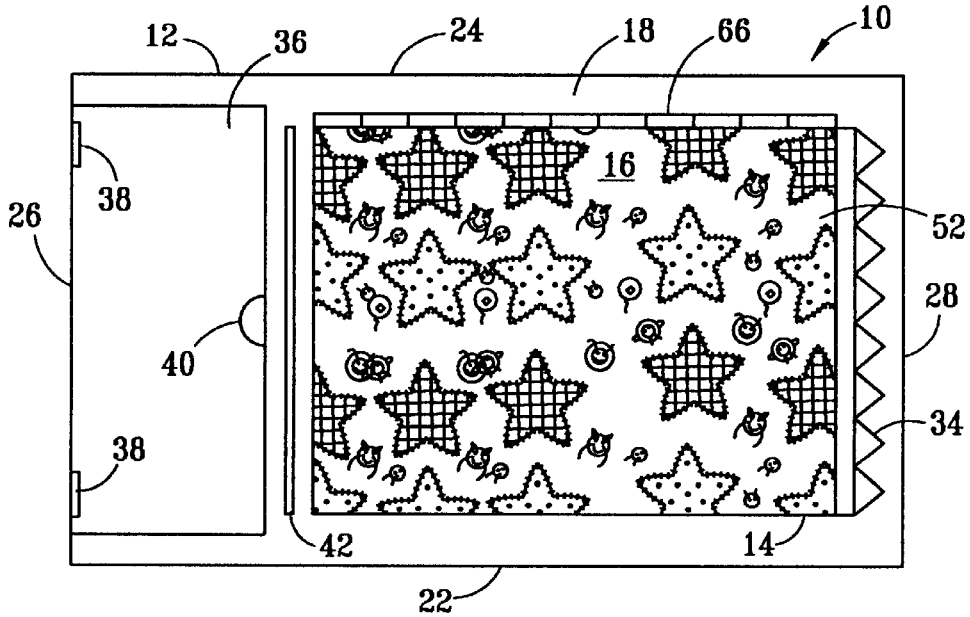
FIG. 9 is a tabletop embodiment of the toy of the present invention.
Figure 10:
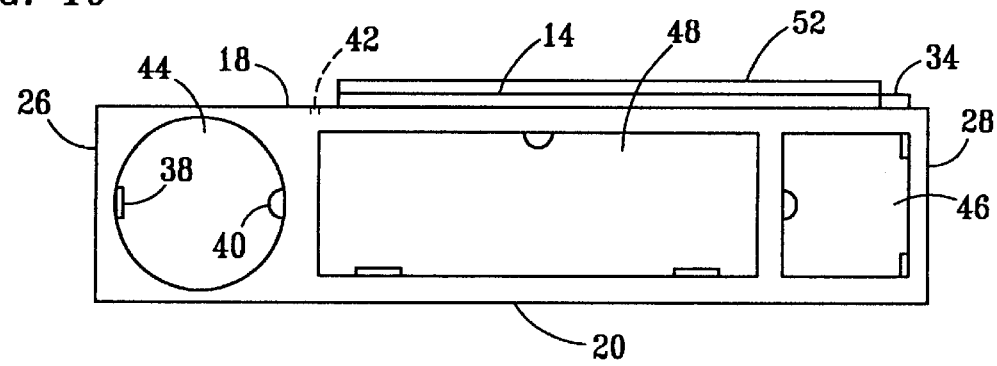
FIG. 10 is a side view of the embodiment shown in FIG. 9.

In the embodiment shown in FIGS. 9 and 10, a toy similar to that shown in FIGS. 7 and 8 is shown. This embodiment of the toy is adapted for use as a tabletop unit. The toy may be placed flat on a flat surface such as a tabletop for use. The translucent cover is hinged, as discussed in connection with FIGS. 7 and 8, and the toy functions in the same way. Alternatively, the message-revealing window and the message-production surface may be on either side of or on the same side of the toy. While the compartments have been shown as those shown in FIGS. 7 and 8, a wide variety of compartment arrangements is possible.

In the present invention, the message paper contains on its message surface a random or repeating pattern of geometric designs, numbers, letters or other symbols to produce a busy design so that when a message is written on the message paper with a relatively hard pencil such as a 4H pencil or harder, the message is not discernable to an observer of the paper. The pattern is desirably a red or a reddish color to achieve this result. Reddish colors such as pink, red, orange and the like are suitable. Preferably the color is red. Desirably the color of the pattern and the color of translucent member 52 are substantially the same. When messages are produced as indicated above, the written message is substantially invisible to parties who do not have a translucent sheet of the same color. The messages, however, are readily interpreted by positioning the messages beneath translucent surface 52, which is of the same color as the pattern, as discussed above. Desirably the messages are written in a black, green or other relatively dark color other than red.

Desirably the message paper is produced in a width compatible with the width of translucent sheet 52 and surface 14. Other widths could be used but it is more difficult to prepare and subsequently read the messages. For convenience, the paper is desirably of a suitable width to slide across surface 14 and into the slots at each end of translucent cover 52.

In some instances it may be desirable to design the toy to use message paper configured as cards having a suitable length and width for compatibility with surface 14 and translucent cover 52, but in most instances it is preferable to supply the paper as a roll which as discussed above is stored and fed across surface 14 as required. The paper may be fed across surface 14 manually or if desired, an electrical feeder with suitable controls may be provided as known to those skilled in the art. In such instances, it would be necessary to provide space in toy body 12 for battery storage and the like. Such feeders are considered to be well known to those skilled in the art.

The cutter 34 may be and desirably is formed as a plastic-edged cutter, which is protected by terminating between the edge of surface 14 and second end 28. While cutter 34 desirably extends a small distance above top 18, it desirably does not extend far enough above the top of surface 18 to pose a cutting risk to the users. Desirably, toy body 12 includes a pencil compartment and may include other compartments as discussed above which may be used for any suitable purpose. Further, if it is desired to make toy body 12 slightly larger as indicated, a battery-powered motor for moving message paper 16 across surface 14 can be included and additional storage space for a second roll of paper and the like can be provided.

Further as discussed above, toy body 12 can be designed to be worn as a necklace by using a suitable chain or other support through receptacle 32, on a belt by use of loops 50, as a bracelet or the like. The toy can also be configured as a tabletop unit. The net result of the use of toy 10 is that a user can write a message on the message paper with the message being substantially invisible to people who do not have a suitable translucent cover to interpret the message. A recipient to whom it is delivered who has a suitable translucent cover 52 can then read the message. This permits children, teenagers and others who wish to transmit messages in this fashion to transmit concealed messages to each other without fear that their playmates, classmates and the like will intercept the message.

Translucent cover 52 can be any suitable material such as cellophane, transparent plastic or the like so long as it is of the desired reddish color found on the message paper.

Figure 11:
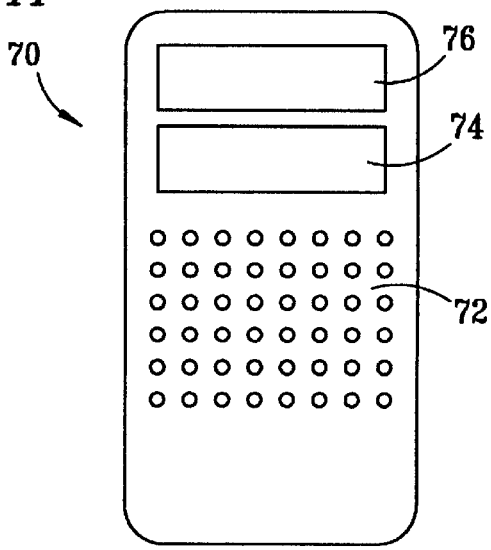
FIG. 11 is an electric/electronic embodiment of the present invention.

In FIG. 11, a further embodiment of the present invention is shown. In this embodiment, an electric/electronic printer

70 is used. The electronic printer 70 may be a printer such as the Brother Label Maker Model PT-100, which prints numbers and letters on a media strip. The media strip for use in the present invention contains a random or repeating pattern of geometric designs, numbers, letters or other symbols to produce a busy design, as described above. Similarly, the design is of a reddish hue as described above. The toy 70 includes a keyboard 72, a display window 74 so that the user of the toy can see the displayed message, and a message-interpretation section 76 adapted to receiving a media strip of the message-containing media for interpretation. The translucent sheet is desirably of the same hue as the design on the message media. The electronic printer may also contain compartments for additional paper rolls, message storage, and the like. Similarly, the electronic toy can be designed for wearing as a necklace, on a belt, as a bracelet/wrist watch, or for use as a tabletop model. The keyboard viewing window and translation window can be arranged in a wide variety of considerations on toy 70.

Having discussed the invention by reference to its preferred embodiments, it is respectfully pointed out that the embodiments described are illustrative rather than limiting in nature and that many variations and modifications are possible within the scope of the present invention. Many such variations and modifications may be considered obvious and desirable by those skilled in the art based upon the foregoing description of preferred embodiments.

I claim:

1. A toy for enabling a first party to produce a concealed message and to reveal a concealed message from a second party; the toy comprising;

a) a toy body having a first side and a second side, a top and a bottom and a first and a second end and including a concealed message-production surface and a concealed message-revealing window; and, b) a message paper of a size and configuration suitable for positioning on the message-production surface and for positioning for viewing through the concealed message-revealing window and having on its message-bearing surface a concealing design of a selected color; the message-producing surface being adapted to support a section of the message paper while a message is written on the section of the message paper, the concealed message-revealing window of the selected color being positionable over a received message.

2. The toy of claim 1 wherein the message-production surface is on the top side of the toy body and wherein the concealed message-revealing window is on the bottom of the toy body.

3. The toy of claim 2 wherein the toy body includes a receptacle for a support to wear the toy as a necklace.

4. The toy of claim 1 wherein the concealed message-revealing window comprises a raised section of translucent material supported to form an opening between the translucent material and a support surface positioned beneath the translucent material so that received messages can be inserted between the translucent material and the support surface to reveal the concealed message.

5. The toy of claim 1 wherein the toy body includes at least one storage compartment.

6. The toy of claim 1 wherein the message paper is provided as a roll of message paper positioned in a message paper holder in the toy body, the holder including a slot positioned to supply message paper to the message-production surface.

7. The toy of claim 1 wherein the toy body includes a safety edge cutter for removing a selected section of message paper.

8. The toy of claim 1 wherein the concealed message-production surface and the concealed message-revealing window are positioned on the same side of the toy.

9. The toy of claim 8 wherein the concealed message-revealing window is formed as a translucent member positionable to permit at least one of use of the message-production surface to generate a message or to cover a message-containing paper on the message-production surface so that the message can be read.

10. The toy of claim 8 wherein the toy includes a receptacle to support the toy as a necklace, on a belt or as a bracelet.

11. The toy of claim 8 wherein the toy is configured for use on a flat surface.

12. The toy of claim 1 wherein the selected color is a reddish hued color selected from red, pink or orange.

13. The toy of claim 12 wherein the concealing design is a random or repeating pattern of geometric designs, numbers, letters, or other symbols.

14. The toy of claim 13 wherein the selected color is red.

15. The toy of claim 14 wherein the message is written in a different color than the selected background color.

16. A toy for enabling a first party to produce a concealed message and to reveal a concealed message from a second party; the toy comprising a message-generating electric or electronic device including a keyboard and a media production system adapted to produce a message on a message-bearing media and a receptacle to accept a message-bearing media for viewing through a translucent window, the media having on its message-bearing surface a concealing design of a selected color.

17. The toy of claim 16 wherein the selected color is a reddish hued color selected from the group consisting of red, pink and orange.

18. The toy of claim 17 wherein the color is red.

19. The toy of claim 17 wherein the toy is adapted to be used on a flat surface or worn as a necklace, from a belt or as a bracelet.

* * * * *